United States Patent [19]

Moon

[11] Patent Number: 4,582,209

[45] Date of Patent: Apr. 15, 1986

[54] SEALING BUNG

[75] Inventor: Robert B. Moon, East Alton, Ill.

[73] Assignee: Shell Oil Company, Houston, Tex.

[21] Appl. No.: 569,365

[22] Filed: Jan. 9, 1984

[51] Int. Cl.[4] ..... B65D 39/00; B65D 39/12

[52] U.S. Cl. ..... 217/108; 220/233; 220/234

[58] Field of Search ..... 217/108, 110, 78, 79; 220/304, 334, 233; 411/43, 34

[56] References Cited

U.S. PATENT DOCUMENTS 2,671,574 3/1954 Wolfe ..... 220/234
3,438,301 4/1969 Mattioli ..... 411/34

FOREIGN PATENT DOCUMENTS 646298 11/1950 United Kingdom ..... 411/34

*Primary Examiner*—Allan N. Shoap

[57] ABSTRACT

Drums or vessels with bungs or orifices having generally cylindrical walls with edges capable of being sealed-against are sealed with closures that deform into contact with those edges and provide seals that are tamper proof.

4 Claims, 7 Drawing Figures

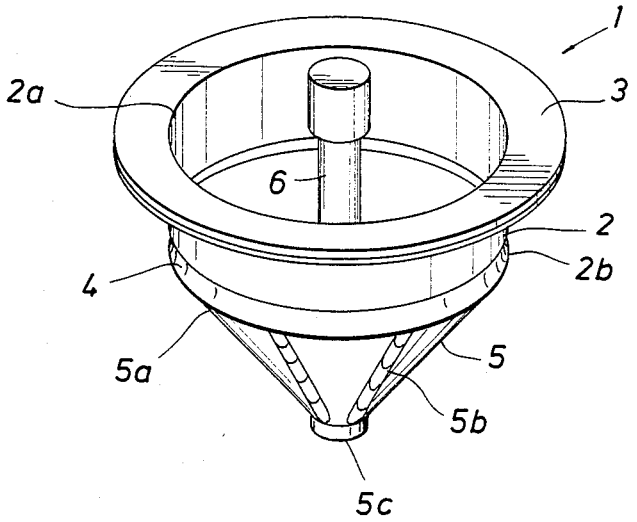
FIG. 1
FIG. 2
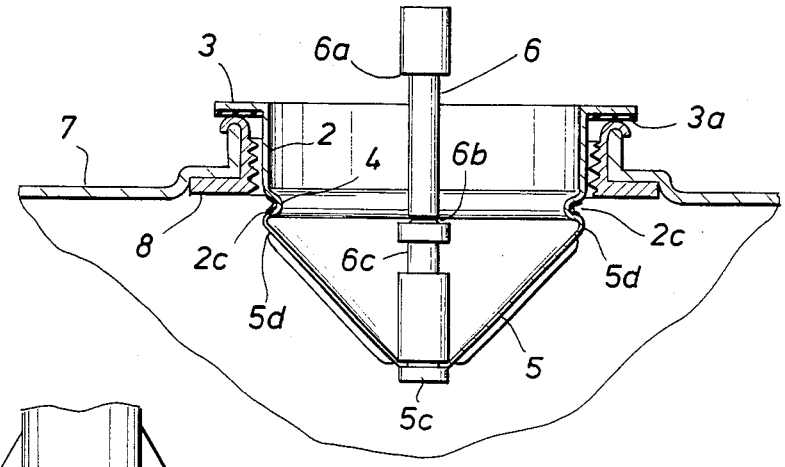
FIG. 3
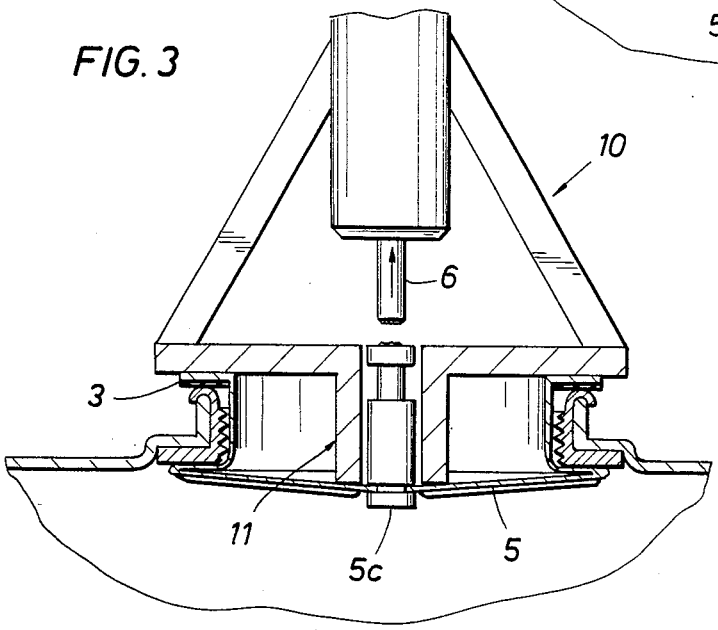
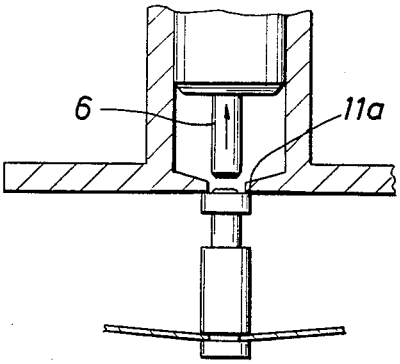
FIG. 3A

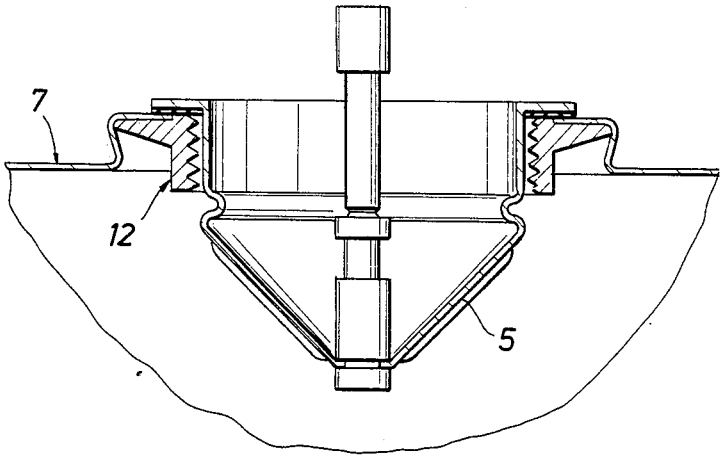
FIG. 4
FIG. 5
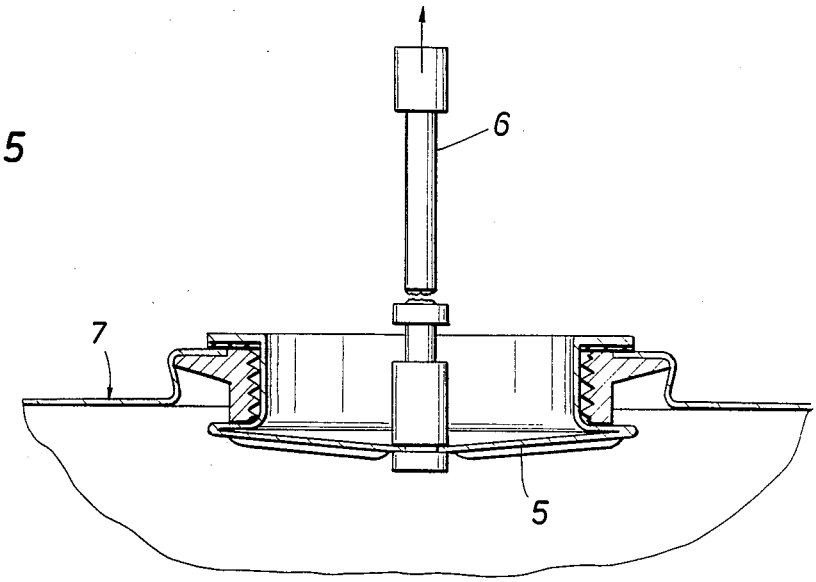
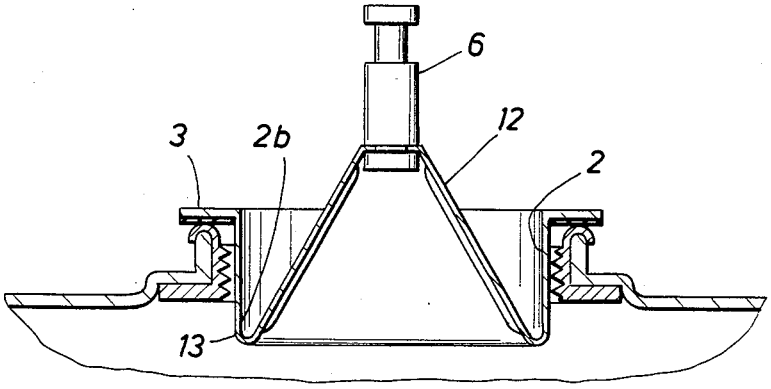
FIG. 6

SEALING BUNG

BACKGROUND OF THE INVENTION

The present invention relates to deformable closures for containers provided with bungs or orifices which have generally cylindrical walls with interior and exterior edges that can be sealed-against. More particularly, the invention relates to tamper-proof closures capable of plugging and sealing orifices in which the orifice walls have various configurations such as internal threads for engaging screw-type closures.

Previously known deformable orifice closures are described in patents such as the following: U.S. Pat. No. 3,648,874 describes a cap-like closure capable of being constricted around the threads on a bottle so female threads are formed in the cap and secure the cap to the bottle. U.S. Pat. No. 3,742,898 describes a beer barrel bung having side walls which are relaxed upon insertion but become compressed by the pressure within the vessel pushing on the bottom wall of the bung. U.S. Pat. No. 4,046,168 describes resilient plugs for closing the ends of tubes in order to prevent inadvertent entry of foreign material. U.S. Pat. No. 4,202,463 describes an orifice closure comprising a wall contacting element and a separately installed inner core for sealing engagement in a generally circular orifice. U.S. Pat. No. 4,287,996 describes a flexible closure having an annular portion connected by a hinge to a central portion so that the annular portion pivots and is compressed between the central portion and a smooth orifice wall.

SUMMARY OF THE INVENTION

The present invention relates to an orifice closure for an orifice having a generally cylindrical wall with generally flat interior and exterior edges. The closure includes a sleeve portion which is at least generally cylindrical and is capable of entering into and extending at least substantially between the interior and exterior edges of the orifice wall. A rigid outwardly extending closure lip portion is located near the exterior edge of the sleeve and arranged to extend beyond and be capable of sealing against the exterior edge of the orifice wall. A closure internal portion which is generally shaped as a truncated cone is connected to the interior edge of the closure sleeve by an annular hinge sealed between that edge and the outer rim of said conical internal portion. In its conical configuration the conical internal portion is capable of entering into the orifice but is arranged so that when the apex portion of the cone is moved toward the interior edge of the closure sleeve member, portions of the sleeve and/or conical internal portion are deflected outward to extend beyond and seal against the interior edge of the orifice wall.

BRIEF DESCRIPTION OF THE DRAWINGS

FIG. 1 is an isometric view schematically illustrating a preferred embodiment of the present orifice closure.

FIG. 2 is a cross sectional view of the present orifice closure inserted into the bung hole of a Tri-sure drum.

FIGS. 3 and 3A are cross sectional views showing the closure of FIG. 2 as drawn into their expanded and sealing configurations by a tool outside the orifice.

FIG. 4 is a cross sectional view of the present closure inserted in the bung hole of a Reike style drum.

FIG. 5 is a cross sectional view of the closure of FIG. 4 in its expanded and sealing position.

FIG. 6 is a cross sectional view of a closure of alternate construction inserted in a bung hole of a Tri-sure style drum.

DESCRIPTION OF THE INVENTION

Figure 7:
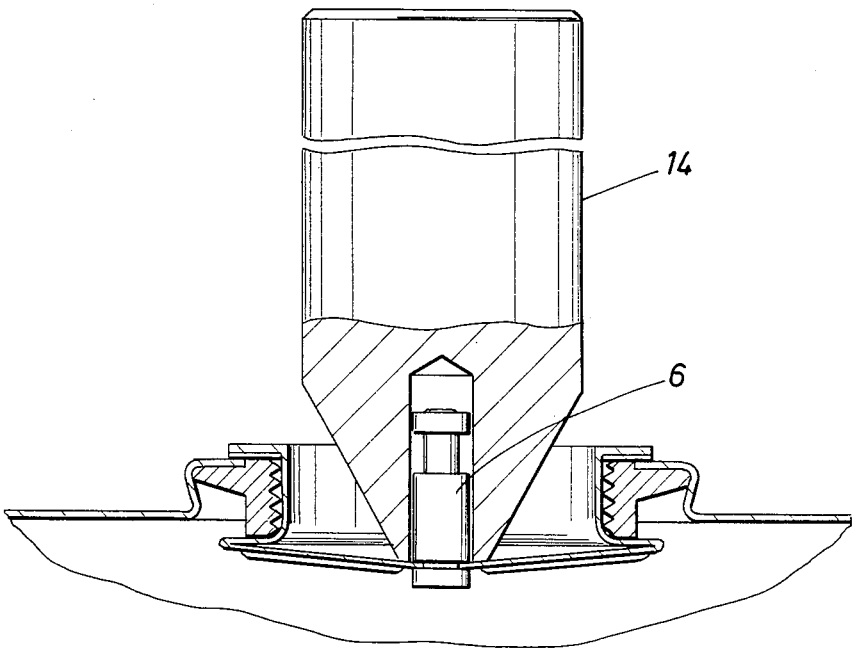
FIG. 7 is a cross sectional view of a punch type of closure sealing or removing tool in engagement with a closure of the present invention.

FIG. 1 shows a particularly preferred embodiment of the present invention designed for use on either Tri-sure or Reike oil drums. As shown, a closure sleeve portion 2 is provided with a generally flat annular lip 3 which is located at least near the exterior edge **2*a* of the sleeve 2** and extends radially outward, for contacting and sealing against the exterior edge of a wall of an orifice.

The interior portion of the closure has the general shape of a truncated cone 5 and is connected to the sleeve 2 by a deformable annular sealing hinge 4 interconnecting the interior edge of the sleeve 2 and the outer rim **5*a* of the conical member 5. The conical member 5, when constructed of malleable material such as sheet metal, preferably contains stiffening convolutions or crinkles 5*b* to enhance the rigidity of the sides of the conical portion while allowing their outward expansion during a movement of the apex or truncated portion 5*c* toward interior edge 2*b* of the sleeve 2. A sheet metal construction can advantageously be used for the sleeve 2. Such a sheet metal sleeve can be corrugated with smoothly curving circular ridges and rows with one being extended to serve as the hinge 4 interconnecting the sleeve to the conical member 5**.

The preferred closure also contains a pin-like means 6 connected to the truncated portion **5*a* for facilitating its movement toward the sleeve edge 2*b*** by a tool operated from outside the orifice.

FIG. 2 shows the closure of FIG. 1 inserted in the bung hole of a steel drum having an orifice of the Tri-sure type, available from substantially all steel drum suppliers (new and reconditioned). The top 7 of such a drum is commonly constructed of 18-gauge steel. The bung hole is surrounded or lined by a threaded collar 8, of the general shape shown. Such a collar or liner provides a generally cylindrical orifice wall which is adapted to receive a threaded bung and also has interior and exterior edges that are generally flat and can be sealed against. As shown, the closure 1 is inserted in the bung hole so that the lip 3 contacts the exterior portion of the orifice wall 8. The pin 6 for facilitating the sealing and removing of the closure 1 is provided with an upper shoulder **6*a*, a break-away notch 6*b* and a lower shoulder 6*c* to facilitate mechanical sealing and removing operations. In the absence of the upper shoulder 6*a***, a tool with jaws can grip the outer surface of the upper stem for effecting the sealing.

To enhance the sealing against the exterior edge of the orifice wall, the lip 3 is preferably coated in the wall engaging area **3*a* with a resilient sealing material. Similarly, the portion 2*c* of sleeve 2 and 5*d* of closure interior 5 are preferably similarly coated with a resilient sealing material to enhance the seal provided by their displacement against the interior edge of the orifice wall 8**.

FIGS. 3 and 3A show the closure 1 drawn into its expanded sealing position in the bung hole of an oil drum having an orifice of the Tri-sure type. As schematically illustrated, a power tool 10 has been positioned to rest on the lip 3 so that a stop shoulder collar 11 or 11*a* is positioned to stop the travel of the truncated portion of a conical element 5 and shear the pin 6 at its break-away notch 6*b*.

FIGS. 4 and 5 show similar insertions and sealings of the closure 1 within the bung hole of a steel oil drum having an orifice of the Reike type (available from all steel drum supplies when you specify Reike type orifice). In the Reike type orifice, the bung hole lining collar 12 and its threads are different from those of the Tri-sure type but, as shown by the drawings, the sealing elements of the present closure are adapted to seal against the generally flat portions of the external and internal edges of the orifice walls of either of those types of orifices.

As shown in FIG. 6, a closure interior portion 12 and hinge means 13 at which it joins to the interior edge of a closure sleeve member 2*b* can be arranged so that the conical element 12 extends above the closure lip 3 when the closure is initially inserted into the orifice. The sealing is then effected by moving the conical portion of the closure interior portion downward toward the interior edge 2*b* of the sleeve 2. In a preferred embodiment the sealing surface of the closure of this configuration is also preferably coated with a resilient sealing material as described in connection with FIG. 2.

FIG. 7 shows a simple manual, punch-type tool for removing a sealed closure element of the type shown in FIG. 1 or either sealing or removing a closure element of the type shown in FIG. 6. In removing either such closure element the pin 6 is simply driven downward by means of the punch until the truncated end of the conical closure interior portion has been displaced away from the sleeve portion of the closure to an extent collapsing the outer rim of the conical member to a diameter allowing it to pass through the orifice which had been sealed. With a closure element of the type shown in FIG. 6, the same punch can be used to drive the pin 6 to the expanded position in which a part or parts of the closure interior portion and/or closure sleeve portion are displaced radially outward to contact and seal against the interior edge of the orifice wall.

Figure 8:
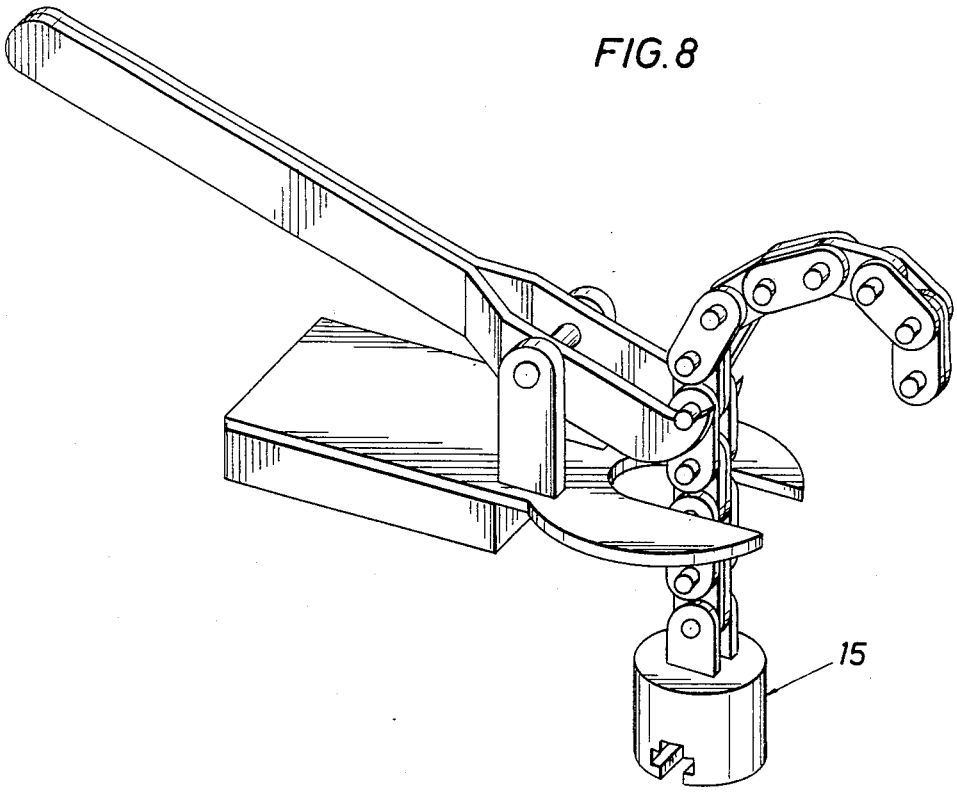
FIG. 8 is a perspective view of an alternative closure removing tool.

FIG. 8 schematically illustrates a chain tong type of tool which can be used to either seal or remove an orifice closure of the type shown in FIG. 1 or to remove an orifice closure of the type shown in FIG. 6. In either such operation the notch and gauging element 15 is engaged with the shoulder 6*c* on pin 6 and then is lifted upward to either move the truncated portion of the conical closure interior portion close enough to the interior edge of the sleeve portion of the closure to cause the expansion and sealing against the interior edge of the closure wall. In removing a closure, pin 6 is raised up far enough to collapse the outwardly displaced parts of the closure interior portion inward far enough to allow the unit to be removed from the orifice.

Figure 9:
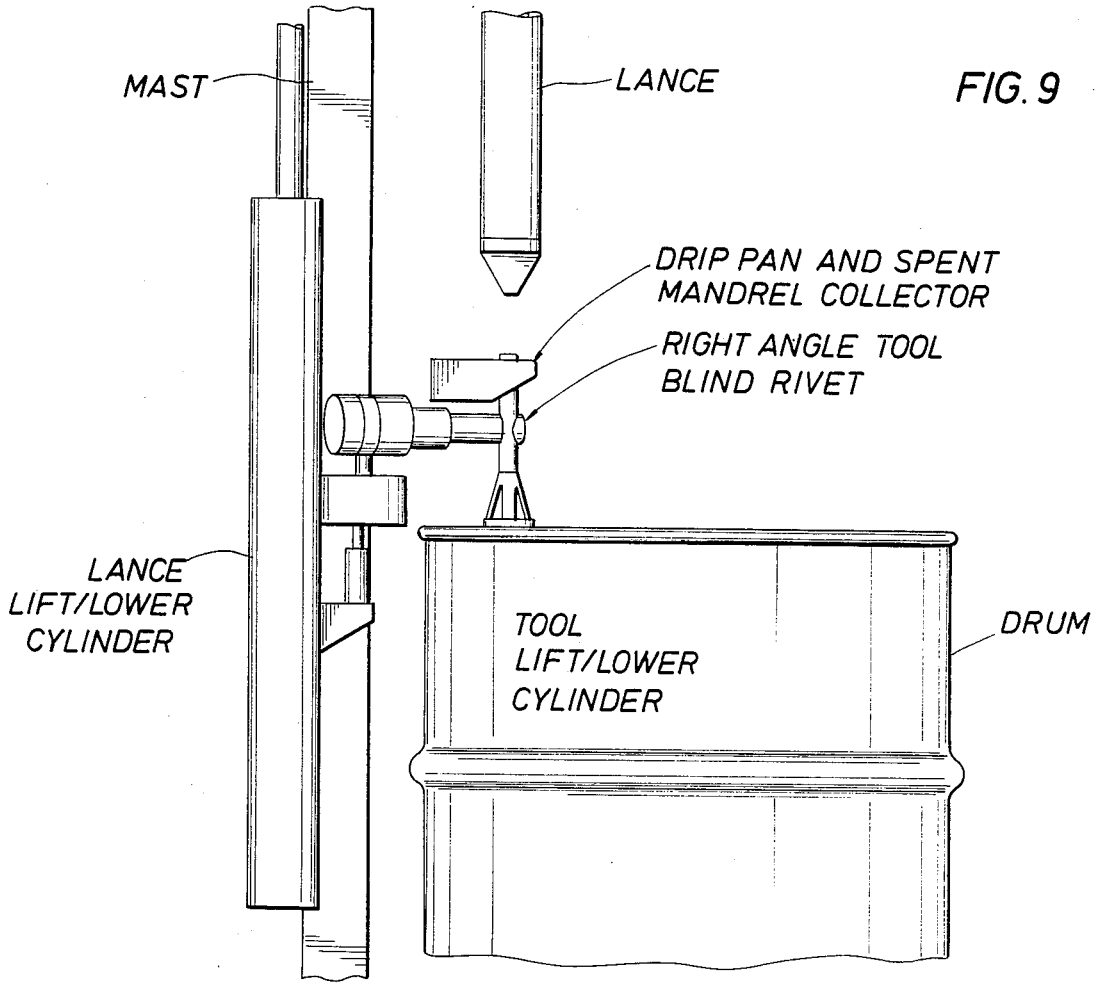
FIGS. 9 and 10 are schematic illustrations of equipment arrangements for an automatic operation in accordance with the present invention.
Figure 10:
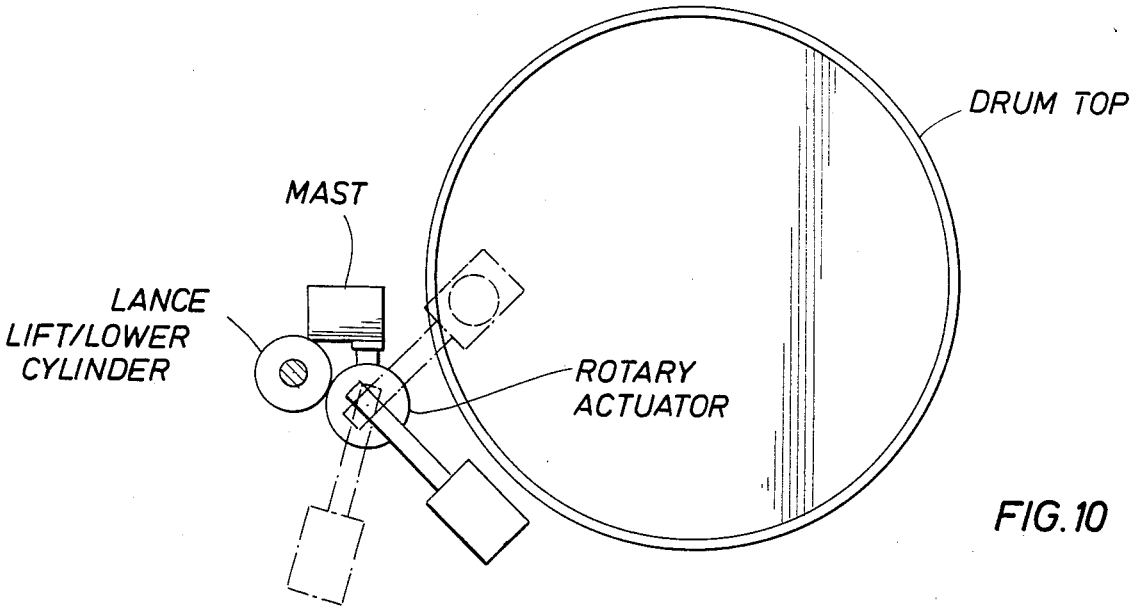

FIGS. 9 and 10 schematically illustrate a system for utilizing the present invention in an automated drum filling station. As shown, the drums are manually or automatically moved into a filling location. A filling lance for inserting the liquid is lowered by a pneumatic lift/lower cylinder to move along the mast and enter the bung hole. When the drum is filled, the lance is raised and an oriented orifice closure, for example, the type shown in FIG. 1, is dropped into the bung hole. A power tool for sealing the closure is swung on an arm adjacent to the filled mast and then lowered into engagement with the closure device. The latter unit would advantageously carry a drip pan arranged above the power unit to both catch drips from the lance tip and the top portions of the pins which are pulled off of the closure sealing actuating pins 6. Substantially all of the components needed for such an operation, with the exception of the drum closure devices themselves, can comprise commercially available items.

In general, the present orifice closures can be constructed of substantially any metal or plastic material having the requisite properties of stiffness, malleability and impermeability. As will be apparent to those skilled in the art, a material suitable for forming an annular fluid-tight hinge about which the orifice closure interior portion must pivot (in order to move from its collapsed to expanded and sealing position) must have properties at least substantially analogous to those of an expandable sheet metal such as a 20-gauge expandable sheet metal. Composites of metal and plastic can, of course, be used and the thickness and rigidity of the portions at or near the apex portion of the conical orifice closure interior portion can be different from that of other portions of the closure. The angle between the sides of the conical portion to its central axis can be varied, for example, by amounts on the order of from 45 degrees to 60 degrees. The size of the truncated portion of the conical element is preferably within the general range of from about 5 to 20 percent of the diameter of the orifice to be closed.

The closures of the present type are particularly advantageous in that a given type of such closures can be easily and quickly inserted and sealed within whichever type of drum orifice happens to arrive at the drum filling location. Sheet metal closures are particularly suitable for use on steel oil drums with bung holes lined with threaded collars to receive screw type plugs such as the Tri-sure and Reike types of drum orifices.

As indicated in the Bureau of Explosives Regulations for Transportation of Explosives and Other Dangerous Articles in rail express and baggage services, ICC No. BOE-6000-C effective May 4, 1983, the regulations for metal barrels, drums, kegs, cases, trunks and boxes, Section 178.80-9, such closures should be adequate to prevent leakage, with gaskets being required, and the closure part being of metal as thick as prescribed for the head of the container, where the container is for more than 12 gallons and the opening to be closed is not over 2.7 inches in diameter. In view of this, the automatic insertion and sealing of the present type closure made of 20-gauge expandable sheet metal may satisfy the requirements for a tamper proof sealing device. The removal of the plug by pulling or driving the conical section into a compressed configuration removable through the orifice destroys the sealing capacity of the device.

What is claimed is:

1. A fluid-tight orifice closure for a vessel containing a orifice having a threaded cylindrical wall which is fluid-tightly connected with the vessel wall and has interior and exterior edges providing sealable annular surfaces comprising:

an impermeable closure sleeve which is cylindrical and is capable of entering into said orifice and extending at least substantially beyond the interior and exterior edges of the orifice wall;

a radially outwardly extending closure lip portion which is located at least near the exterior edge of the closure sleeve for extending beyond and sealing against the annular surface of the exterior edge of the orifice wall;

a closure interior portion which is shaped generally as a truncated cone and is fluid-tightly connected to the interior edge of the closure sleeve by an impermeable annular sealing hinge between the interior edge of the sleeve portion and the outer rim of said conical element, so that in conical configuration the conical element is capable of passing through the orifice but when the apex portion of the conical element is moved toward the interior edge of the sleeve portion, portions of the sleeve and/or conical element are displaced radially outward to extend beyond and seal against the annular surface of the inner edge of the orifice wall;

mechanical means connected to the apex portion of said conical element for engagement with and movement by a tool operated from outside the orifice; and said annular sealing hinge having properties of stiffness, malleability and impermeability at least substantially analogous of those of 20-gauge expandable sheet metal, so that said sealing engagements between the annular surfaces of the exterior and interior edges of the orifice and portions of the closure sleeve are drawn into and are held in place by the properties of that hinge without significant compression of the sides of the cylindrical closure sleeve out wardly into contact with the side wall of the orifice.

2. The closure of claim 1 in which said apex portion is arranged for movement away from the interior of the vessel toward the interior edge of the closure sleeve portion in order to cause the sealing against the interior edge of the orifice wall.

3. The closure of claim 2 in which said tool engaging means is a pin-shaped projection from the apex portion of said conical element and contains a ledge-like surface irregularity for engagement with a tool for effecting the movement.

4. The closure of claim 3 in which said pin-shaped projection also has a cylindrical portion above a breakaway notch with the cylindrical portion being located above the notch and suited for engagement by the jaws of a pin-lifting power tool.

* * * * *